US009637340B1

(12) United States Patent
Butler et al.

(10) Patent No.: US 9,637,340 B1
(45) Date of Patent: May 2, 2017

(54) AUTOMATIC SLEEVING SPLICER

(71) Applicant: Butler Automatic, Inc., Middleborough, MA (US)

(72) Inventors: Andrew P. Butler, Marion, MA (US); Jeffrey A. Greenwood, Franklin, MA (US); Robert A. Mavilia, Braintree, MA (US); Michael A. Mucci, Upton, MA (US); Christopher D. Wilson, Milford, MA (US)

(73) Assignee: BUTLER AUTOMATIC, INC., Middleborough, MA (US)

( * ) Notice: Subject to any disclaimer, the term of this patent is extended or adjusted under 35 U.S.C. 154(b) by 59 days.

(21) Appl. No.: 14/669,257

(22) Filed: Mar. 26, 2015

Related U.S. Application Data

(60) Provisional application No. 61/970,507, filed on Mar. 26, 2014.

(51) Int. Cl.
*B65H 19/10* (2006.01)
*B65H 19/18* (2006.01)
*B65H 21/00* (2006.01)

(52) U.S. Cl.
CPC ..... *B65H 21/00* (2013.01); *B65H 19/18* (2013.01); *B65H 19/1852* (2013.01); *B65H 19/102* (2013.01); *B65H 2301/4607* (2013.01); *B65H 2301/4622* (2013.01); *B65H 2301/4641* (2013.01); *B65H 2301/46314* (2013.01)

(58) Field of Classification Search
CPC .. B65H 21/00; B65H 19/102; B65H 19/1842; B65H 19/20; B65H 2301/4607; B65H 2301/4617; B65H 2301/46174; B65H 2310/4622; B65H 2301/46314; B65H 2301/4641; B65H 19/1852; B65H 2301/4622
See application file for complete search history.

(56) References Cited

U.S. PATENT DOCUMENTS 4,652,329 A * 3/1987 Focke ..... B65H 19/1852 156/351
5,679,195 A * 10/1997 O'Dwyer ..... B65H 19/1852 156/159
5,975,457 A * 11/1999 Forbes ..... B65H 19/102 242/552
6,013,148 A * 1/2000 Bluemle ..... B65H 19/1852 156/159
6,500,288 B2 * 12/2002 Hara ..... B65H 19/1852 156/157
6,817,566 B2 * 11/2004 Clifford ..... B65H 19/14 156/564
7,708,043 B2 * 5/2010 Pasqualoni ..... B65H 19/1873 156/157
9,340,387 B2 * 5/2016 Giuliani ..... B65H 19/102

* cited by examiner

*Primary Examiner* — Mark A Osele
(74) *Attorney, Agent, or Firm* — Cesari and McKenna, LLP

(57) ABSTRACT

A system and method for automatic splicing of rolls of sleeve material used in various packaging markets is provided. The system will automatically splice the prepared end of a new roll onto the expiring end of the prior roll. The system performs an automatic cut and splice operation resulting in a butt splice of the two rolls with tape applied to both sides of the splice joint. The splice can be done in-registration to provide a consistent product repeat length between expiring and new rolls.

8 Claims, 5 Drawing Sheets

AUTOMATIC SLEEVING SPLICER

CROSS-REFERENCE TO RELATED APPLICATIONS

The present application claims the benefit of U.S. Provisional Patent Application Ser. No. 61/970,507, which was filed on Mar. 26, 2014, by Andrew P. Butler, et al for an AUTOMATIC SLEEVING SPLICER and is hereby incorporated by reference.

FIELD OF THE INVENTION

The present invention is directed to splicing systems and, more particularly, to sleeving splicers.

SUMMARY OF THE INVENTION

The disadvantages of the prior art are overcome by providing a system and method for automatic splicing of rolls of sleeve material used in various packaging markets. The system will automatically splice the prepared end of a new roll onto the expiring end of the prior roll. The system performs an automatic cut and splice operation resulting in a butt splice of the two rolls with tape applied to both sides of the splice joint. The splice can be done in-registration to provide a consistent product repeat length between expiring and new rolls.

BRIEF DESCRIPTION OF THE DRAWINGS

The above and further advantages of the present invention are described herein in relation to the following figures, in which identical numerals indicate identical or functionally similar elements.

DETAILED DESCRIPTION OF AN ILLUSTRATIVE EMBODIMENT

System Description

Figure 1B:
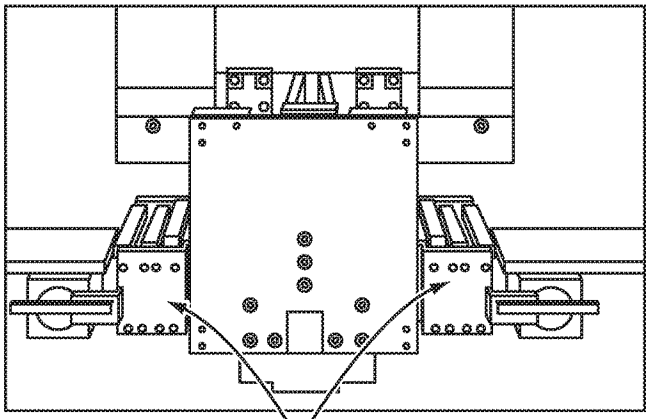
FIG. 1B is a side view of an automatic sleeving splicer in accordance with an illustrative embodiment of the present invention.
Figure 1A:
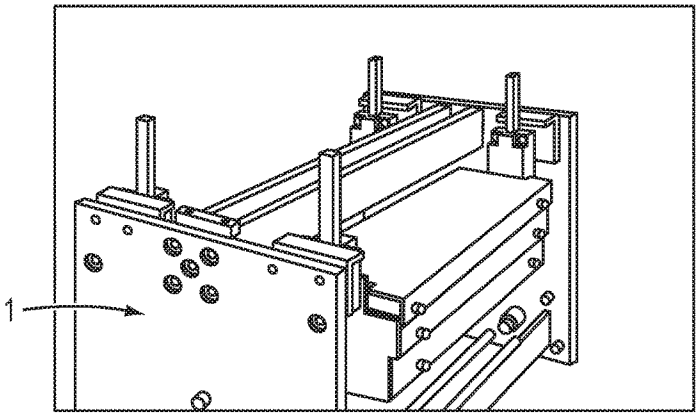
FIG. 1A is a perspective view of an automatic sleeving splicer in accordance with an illustrative embodiment of the present invention.
Figure 1D:
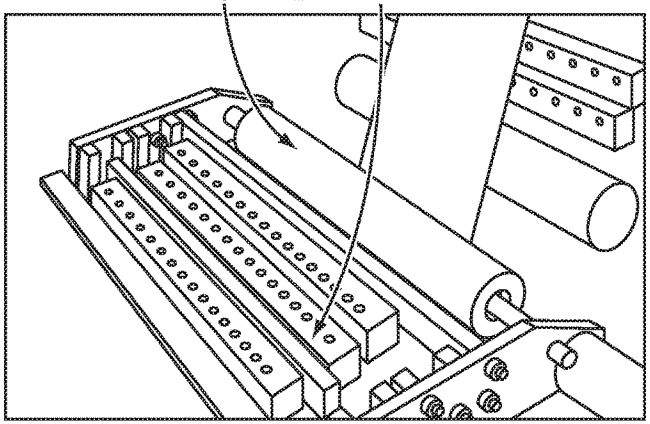
FIG. 1D a perspective view of an automatic sleeving splicer in accordance with an illustrative embodiment of the present invention.

The present invention is designed to provide a non-stop supply of sleeve material to downstream application systems as is known in the art. The system illustratively comprises of a frame 1 (FIG. 1A) on which are operatively mounted opposing sub-frame assemblies 2 (as shown in FIG. 1B). Illustratively each sub-frame assembly 2 comprises of a guide roll 6 (FIG. 1D). One of the guide rolls on a first sub-assembly 2 is utilized for the currently running roll of material, while the second guide roll of the second sub-assembly 2 is utilized for the new roll. During operation, the two guide rolls will alternate between being associated with the currently running roll of material and with the new roll. That is, as one roll is completed, the new roll will become the currently running roll, while the operator will replace the completed roll so that it will become the new roll.

Illustratively, each sub-assembly comprises of a first moving nip bar 3 (FIG. 1C) and a second moving nip bar 4 (FIG. 1D). The first moving nip bar 3 illustratively performs a dual purpose. A first use is to provide a vacuum to hold a prepared slice for the new roll. The first nip bar 3 also is utilized to apply force to the opposing nip and running web for the purpose of adhering the new roll to the cut end of the expiring roll. Illustratively, the second moving nip bar 4 is utilized to use a vacuum to hold the tape to be applied to the opposite side of the splice joint. Further, the second moving nip bar 4 is also utilized to apply force to the opposing nip to adhere the splice tape to the second (opposite) side of the splice joint.

Figure 1C:
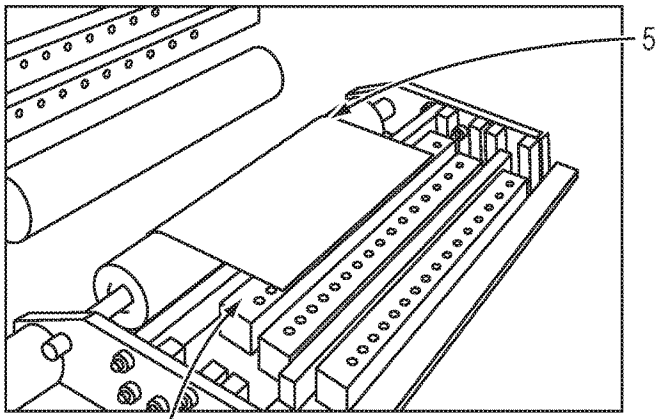
FIG. 1C a perspective view of an automatic sleeving splicer in accordance with an illustrative embodiment of the present invention.

Each of the sub assemblies also illustratively comprises of a fixed metal preparation bar 5 (FIG. 1C). The metal preparation bar 5 illustratively includes vacuum capability to hold a prepared splice in place as well as a set of measurement scales for alignment of the prepared web with the running web. Further, an idler roller 6 is also included on each sub-assembly 2 for web guiding during the splice preparation.

Figure 2:
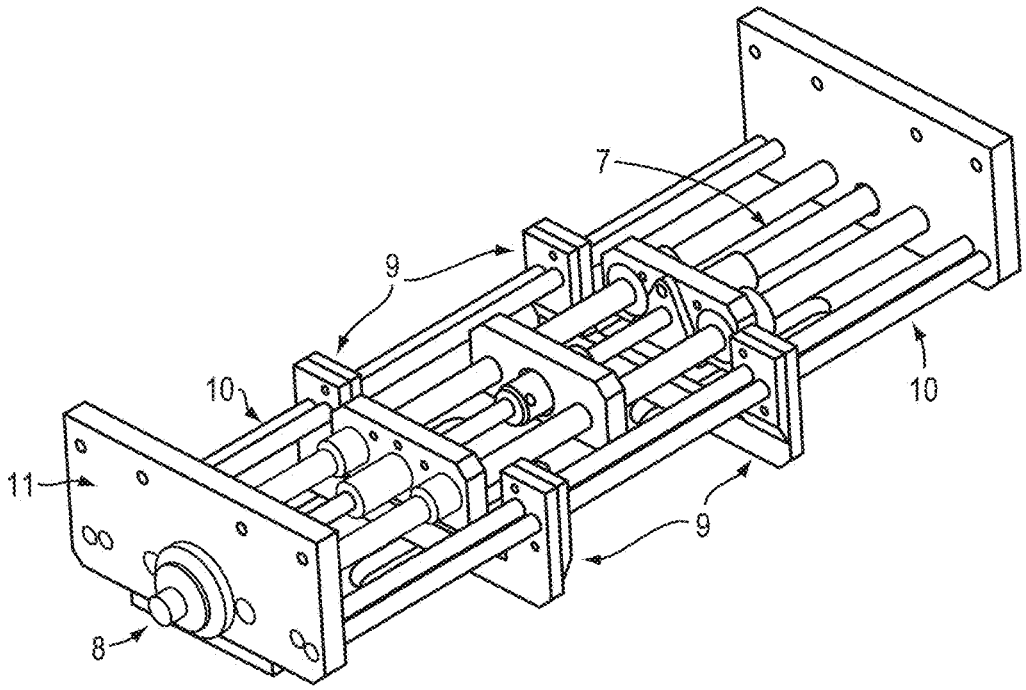
FIG. 2 is a perspective view of a guide system in accordance with an illustrative embodiment of the present invention.

FIG. 2 is a perspective view of exemplary guiding mechanism 11 in accordance with an illustrative embodiment of the present invention. The guiding mechanism 11 illustratively comprises of a dual thread ball screw 7 that illustratively comprises a plurality of guide arms 9 attached for centering of the traverse wound sleeving web. The guide arms 9 are illustratively implemented as tapered plates to provide the centering of the sleeving web during a splicing operation. Illustratively two offset guide rods 10 pass through the guide plates 9 to provide a narrow space for web materials to pass through. The offset guide rods 10 also strengthen the web for edge guiding functionality. The mechanism 11 may also illustrative including a knob 8 for rotating the dual thread ball screw 7 to adjust the guide plates 9. Illustratively the knob 8 is utilized to rotate the dual thread ball screw in a way that adjusts and centers the guide plates 9 in a single operation. However, in alternative embodiments, a plurality of knobs, or other adjustment mechanisms, may be utilized to center and adjust the guide plates 9 separately. Thus, the description of a single knob 8 should be taken as exemplary only. Further, it should be noted that while a knob is shown and disclosed in accordance with an illustrative embodiment of the present invention, other techniques for adjusting and centering the guide plates 9 may be utilized in accordance with alternative embodiments of the present invention. As such, the description of a knob 8 should be taken as exemplary only.

Figure 3:
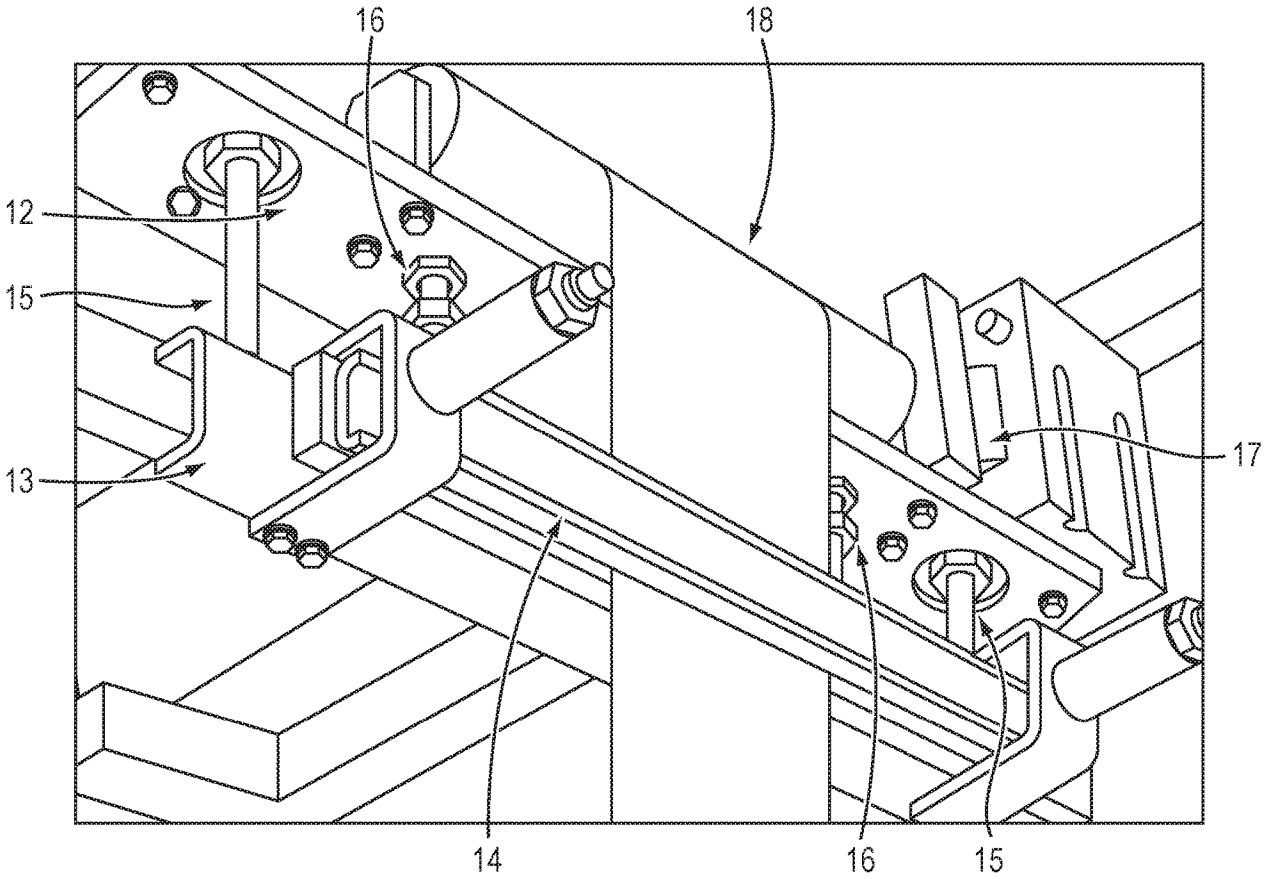
FIG. 3 is a perspective view of a sub-frame in accordance with an illustrative embodiment of the present invention.

FIG. 3 is a perspective view a further assembly in accordance with an illustrative embodiment of the present invention. The assembly comprises of a frame 12 that is operatively interconnecting a sub frame 13. Illustratively, the subframe 13 is configured to support a nip bar 14 that isolates the supply rolls and the splice operation from a downstream process tension and material flow. Brackets (other means) 15 are utilized to actuate the nip bar in line with the web direction provided between the frame 12 in subframe 13. The actuators 15 both actuate the nip bar as well as provide a fixed and repeatable advance of the web application of the second side splice tape. Travel stops 16 are operatively mounted between the frame 12 and subframe 13 and are configured to provide adjustability to the amount of the web advance prior to the application of the second side tape. Illustratively, sensors 17 are mounted to provide end of travel location feedback of the moving nip bar. An idler roll 18 is provided to provide a web path from the splice head through the moving nip and out to the accumulator (not shown).

Figure 4A:
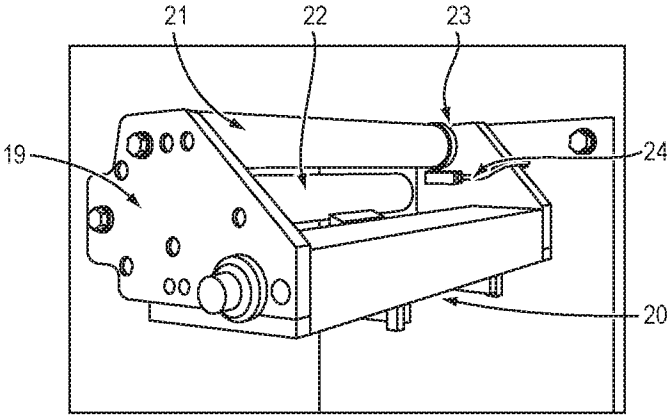
FIG. 4A is a perspective view of a frame in accordance with an illustrative embodiment of the present invention.

FIG. 4A is a perspective view of a frame 19 in accordance with an illustrative embodiment of the present invention. The frame 19 illustratively comprises a guiding system 20, such as that described above in reference to FIG. 3, that is operatively connected to a first idler roll 21 and a second idler roll 22. The first idler roll 21 is utilized to guide the web through the splice head and alignment assembly of the automatic sleeve splicer. The second idler roll 22 is illustratively configured to provide a large wrap angle around the idler roll 21. Further, the idler roll 22 works to guide the web vertically into the nip/advance module.

Figure 4B:
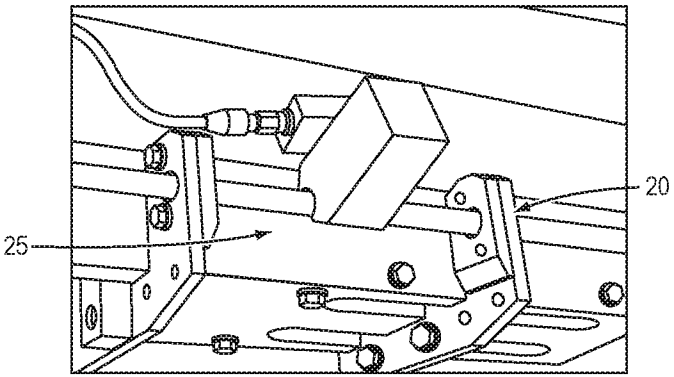
FIG. 4B is a perspective view of an optical register mount in accordance with an illustrative embodiment of the present invention.

An encoder 23 is operatively connected to the first idler roll 21. A fixed sensor 24 is operatively interconnected with the encoder 23 to provide feedback of the web speed from the supply roll into the accumulator. There is further a mount for an optical registration sensor 25 (FIG. 4B) that is integrated into the upper alignment system.

Figure 5:
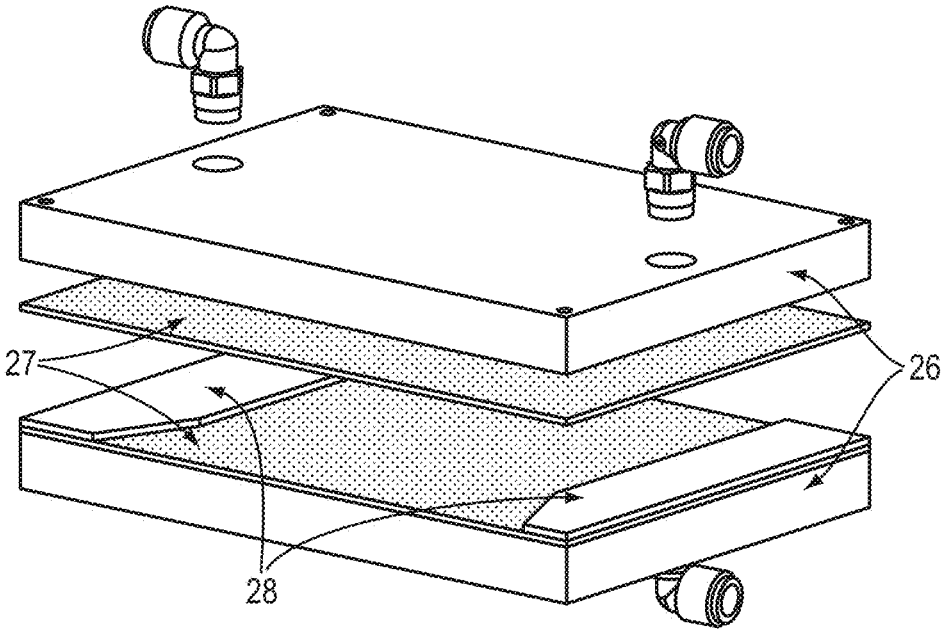
FIG. 5 is an exploded view of sub-plates that provide a plenum in accordance with an illustrative embodiment of the present invention.

FIG. 5 is an exploded perspective view of an exemplary guide plate system in accordance with an illustrative embodiment of the present invention. The guide plate system comprises a pair of opposing sub-plates 26 that provide a plenum for air under pressure. Air is provided by air intake nozzles from a pressurized air source (not shown). Perforated surface plates 27 are mounted to each plenum from which air flows to create a low friction surface upon which the web (not shown) passes. A self centering edge guide plate system 28 provides guiding action to the web.

It should be noted that the system hardware description contained above is in relation to an exemplary embodiment. Thus, variations and modifications may be made from the description contained herein without departing from the spirit or scope of the present invention.

System Operation

A description of the operation of the novel automatic sleeving splicer is provided herein. As will be appreciated by one skilled in the art, the system operation description should be read in conjunction with the above system hardware description. In operation, the splicer is loaded with the material which is webbed through the guiding system, splice head, nip advance, and accumulator and provided to the downstream process equipment. The upper and lower guides are adjusted to suit the width of the material being run on the machine.

Using encoders before and after the accumulators, the control system drives the core-driven roll shafts at the appropriate speed to maintain a pre-defined level of storage in the accumulator. The speed at which the core is driven is calculated based on feedback from the encoders on the drive system and the encoders before and after the accumulator. An estimated time before the running roll expires is provided on the user interface and is based upon the speed-related control items and user-input caliper of the web.

While the running roll is supplying material to the process, the operator loads the next roll of material onto the opposite core drive shaft. The material is webbed through the system and to the splice head. The non-running side of the splice head is opened, upon which vacuum is turned on automatically to only the preparation and nip bars. The operator webs the new material through the associated side of the lower guide system and over the idler roll on the head to the preparation bar. The splice is prepared using the cutting edge guides and lateral alignment scales provided on the preparation bar. The vacuum to the preparation and nip bars hold the splice in place. The non-running side of the head is then closed.

The operator then opens the running side of the head where the vacuum has been automatically turned on to the second side tape application nip bars. The operator places a piece of tape, adhesive side up, over the vacuum holes, using the alignment scales provided to ensure proper positioning relative to the running web. The operator then closes the running side of the head. Using line speed data collected from the encoders on the system and the user-input material caliper, the system will initiate an automatic splice when the calculated outside diameter of the running roll becomes less than a user-defined minimum value.

If in-registration splice mode has been selected on the user interface, the system will automatically slow the drives down to a pre-defined scan speed. Using an optical sensor, the system will find a registration mark on the running material. Once the mark is located, the system will advance the web a user-defined distance such that the splice takes place at the desired location on the web. If in-registration is not selected, the drive will decelerate to zero speed at the predetermined minimum outer roll diameter.

During the deceleration, scan, and splice sequences the downstream process will continue to be supplied material at the process-defined line speed by consuming material stored within the accumulator. When the web is properly positioned for the splice and the drives have decelerated to zero speed, the accumulator/web advance nip will close on the web thereby isolating the splicing activities from the downstream process tension and material flow.

The splice head will then fire the primary nip on the running side of the head, thereby compressing the running web against the exposed tape on the prepared splice to join the two webs of material. A knife on a moving shuttle then cuts the expiring web in a precise location to provide a butt splice at the user-specified location. With the expiring web cut and the running web now adhered to the new roll, the primary nip will retract.

The upper accumulator/web advance nip will then advance the web by moving a predefined distance in the in-web direction. Sensors in the nip advance provide confirmation of the completed motion. Upon completion of the web advance the second side tape nip bars extend from both sides of the head to apply the tape and backing force for the opposite side of the web. The second side tape nip bars then retract to complete the splice and two-side tape application process.

The accumulator/web advance nip then opens and the new running roll is accelerated to a value higher than the calculated line speed until the accumulator has returned to a pre-defined fill state, as indicated by sensors within the accumulator that monitor the position of the moving dancer. Once the pre-defined fill state is achieved the drive speed returns to a value that matches the process line speed. The operator would then remove the expired roll from the roll drive, replace it with new material, and repeat the process noted above to provide a non-stop supply of material to the downstream processes.

The above description is directed to exemplary embodiments of the present invention. As will be appreciated by those skilled in the art various modifications may be made to the description contained herein without departing from the spirit or scope of the invention.

What is claimed is:

1. A sleeve splicer comprising:

a frame operatively connected to a first sub-frame and a second sub-frame, the first and second sub-frames located on opposite sides of the frame, the first sub-frame having a first vertical path for sleeve material originating on a first roll, the second sub-frame having a second vertical path for sleeve material originating on a second roll;

the first sub-frame having a first moving nip bar and a second moving nip bar, the first moving nip bar configured to use vacuum to hold an end of a first new roll and apply force, the second moving nip bar configured to use vacuum to hold a first tape to be applied and apply force;

a first fixed preparation bar operatively connected to the first sub-frame, the first preparation bar configured with vacuum to hold the end of the first new roll in place in conjunction with the second moving nip bar and further configured with a set of measurement scales to align the end of the first new roll with a running web.

2. The sleeve splicer of claim 1 wherein the first sub-frame further comprises a first idler roll.

3. The sleeve splicer of claim 1 wherein the second sub-frame comprises a third moving nip bar and a fourth moving nip bar, the third moving nip bar configured to use vacuum to hold an end of a second new roll and apply force, the fourth moving nip bar configured to use vacuum to hold a second tape to be applied and apply force.

4. The sleeve splicer of claim 3 further comprising a second fixed preparation bar operatively connected to the second sub-frame, the second preparation bar configured with vacuum to hold the end of a second new roll in place in conjunction with the third moving nip bar and further configured with a second set of measurement scales to align the end of the second new roll with the running web.

5. The sleeve splicer of claim 1 further comprising a first idler roll on the first sub-frame and a second idler roll on the second sub-frame.

6. The sleeve splicer of claim 1 further comprising a guide mechanism, the guide mechanism further comprising:

a dual thread ball screw operatively connected to a plurality of guide arms having tapered plates for centering a web; and a pair of offset guide rods that pass through the plurality of guide arms to provide a space for web material to pass through.

7. The sleeve splicer of claim 6 further comprising a knob configured to rotate the dual thread ball screw wherein rotation of the dual thread ball screw adjusts the plurality of guide arms.

8. The sleeve splicer of claim 7 wherein the adjusting of the plurality of guide arms comprises simultaneously centering the plurality of guide arms.

* * * * *